US005241573A

United States Patent [19]

Thacker

[11] Patent Number: 5,241,573

[45] Date of Patent: Aug. 31, 1993

[54] SHIELD APPARATUS

[76] Inventor: Michael S. Thacker, 405 Center St., Channahon, Ill. 60410

[21] Appl. No.: 818,135

[22] Filed: Jan. 8, 1992

[51] Int. Cl.[5] ..... G21F 3/04

[52] U.S. Cl. ..... 376/287; 250/517.1

[58] Field of Search ..... 376/287, 288, 459; 250/515.1, 517.1, 518.1, 519.1; 52/595, 593; 976/DIG. 321, DIG. 322, DIG. 320, DIG. 340

[56] References Cited

U.S. PATENT DOCUMENTS 2,942,115 6/1960 O'Connell ..... 376/287
3,010,888 11/1961 Battle ..... 376/459
3,614,446 10/1971 Leuthold et al. ..... 250/517.1
4,400,623 8/1983 Jacobson ..... 376/287

FOREIGN PATENT DOCUMENTS 61-91599 5/1986 Japan ..... 250/517.1

*Primary Examiner*—Daniel D. Wasil
*Attorney, Agent, or Firm*—Leon Gilden

[57] ABSTRACT

A shield apparatus is arranged for ease of mounting in assembled configuration particularly for use in shielding various radiations, such as relative to nuclear plants. The shielding structure is arranged for use in emergency as well as in a permanent relationship relative to such radiation emitting structure.

3 Claims, 4 Drawing Sheets

SHIELD APPARATUS

BACKGROUND OF THE INVENTION

1. Field of the Invention

The field of invention relates to shield apparatus, and more particularly pertains to a new and improved shield apparatus wherein the same is arranged for ease of assemblage in use.

2. Description of the Prior Art

In the shielding of nuclear radiation relative to nuclear plants, typically, large steel containers are utilized in a position and subsequently filled with water for erection of such sealed structure. To overcome the bulky and awkward nature of such prior art structure, the instant invention attempts to overcome deficiencies of the prior art by providing interlocking and interengaging structure utilizing tongue and groove interrelationships. Prior art radiation shielding is exemplified in U.S. Pat. No. 4,878,324 to Rissel wherein shielding blocks formed of steel for filling with concrete are set forth.

U.S. Pat. No. 4,712,015 to Aspden sets forth shields for nuclear reactors, including an inner portion rotatable about a vertical axis and connection between an inner and outer portion permitting relative angular movement between the portions without loss of containment of the structure.

Further examples of shielding structure for nuclear facilities is set forth in U.S. Pat. No. 4,071,404 to Aoki; U.S. Pat. No. 4,729,869 to Schukei, et al.; and U.S. Pat. No. 4,795,654 to Teleki.

Accordingly, it may be appreciated that there continues to be a need for a new and improved shield apparatus as set forth by the instant invention which addresses both the problems of ease of use as well as effectiveness in construction in providing assemblage to officially shield gamma radiation relative to a nuclear facility and in this respect, the present invention substantially fulfills this need.

SUMMARY OF THE INVENTION

In view of the foregoing disadvantages inherent in the known types of shield apparatus now present in the prior art, the present invention provides a shield apparatus wherein the same is arranged for shielding gamma radiation relative to a radiation emitting facility. As such, the general purpose of the present invention, which will be described subsequently in greater detail, is to provide a new and improved shield apparatus which has all the advantages of the prior art shield apparatus and none of the disadvantages.

To attain this, the present invention provides a shield apparatus arranged for use in shielding various radiations, such as relative to nuclear plants. The shielding structure is arranged for use in emergency as well as in a permanent relationship relative to such radiation emitting structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shield apparatus which has all the advantages of the prior art shield apparatus and none of the disadvantages.

It is another object of the present invention to provide a new and improved shield apparatus which may be easily and efficiently manufactured and marketed.

It is a further object of the present invention to provide a new and improved shield apparatus which is of a durable and reliable construction.

An even further object of the present invention is to provide a new and improved shield apparatus which is susceptible of a low cost of manufacture with regard to both materials and labor, and which accordingly is then susceptible of low prices of sale to the consuming public, thereby making such shield apparatus economically available to the buying public.

Still yet another object of the present invention is to provide a new and improved shield apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
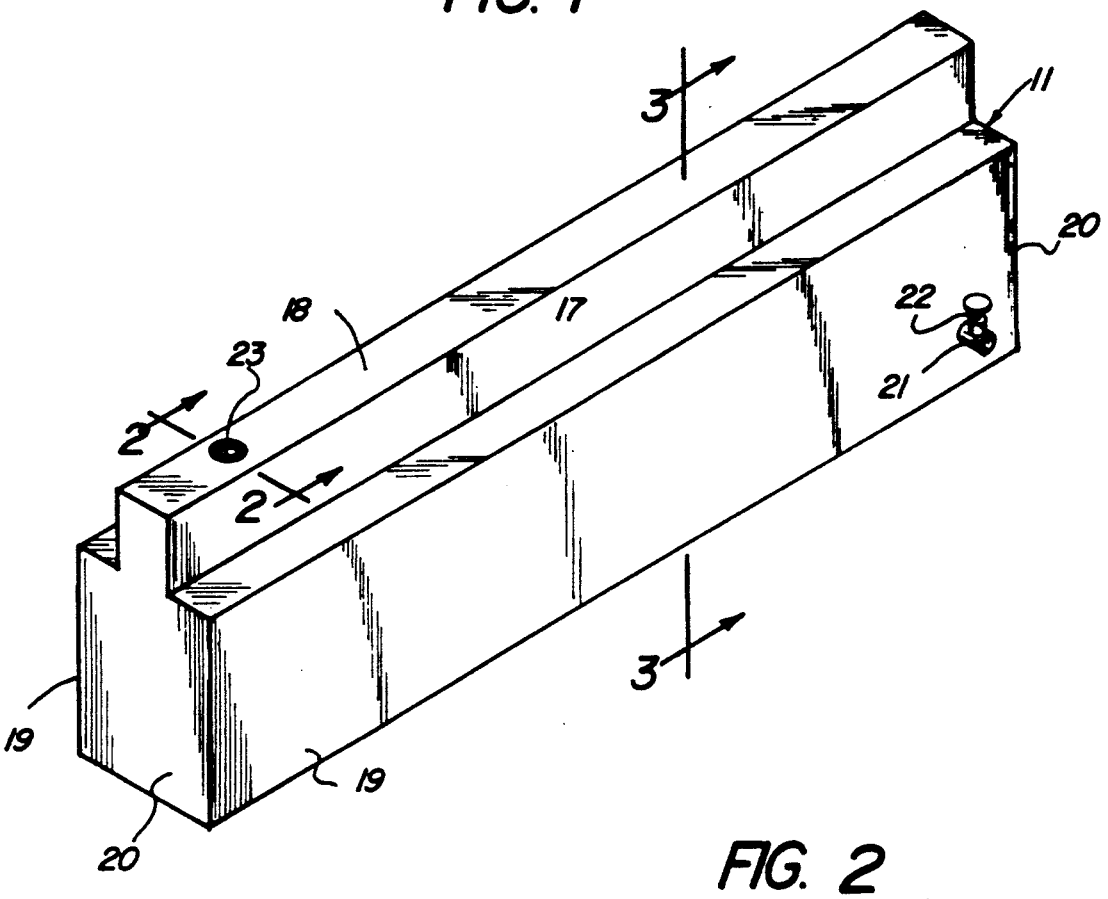
FIG. 1 is an isometric illustration of a first block utilized by the invention.
Figure 2:
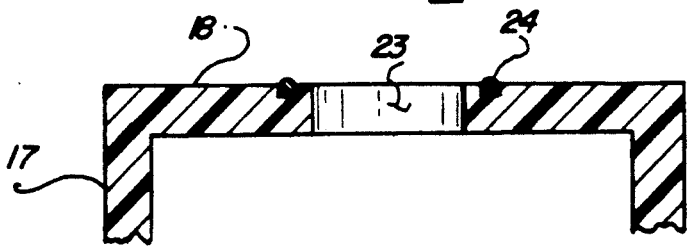
FIG. 2 is an orthographic view, taken along the lines 2—2 of FIG. 1 in the direction indicated by the arrows.
Figure 3:
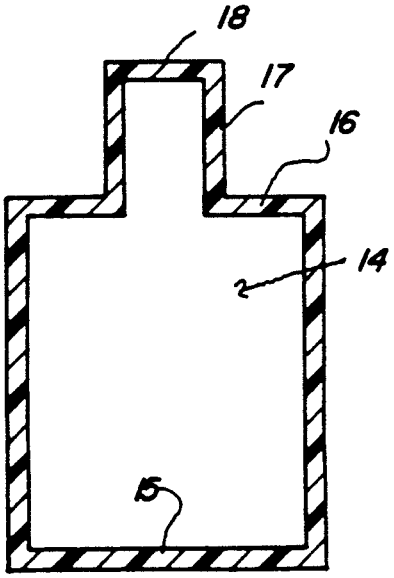
FIG. 3 is an orthographic view, taken along the lines 3—3 of FIG. 1 in the direction indicated by the arrows.
Figure 4:
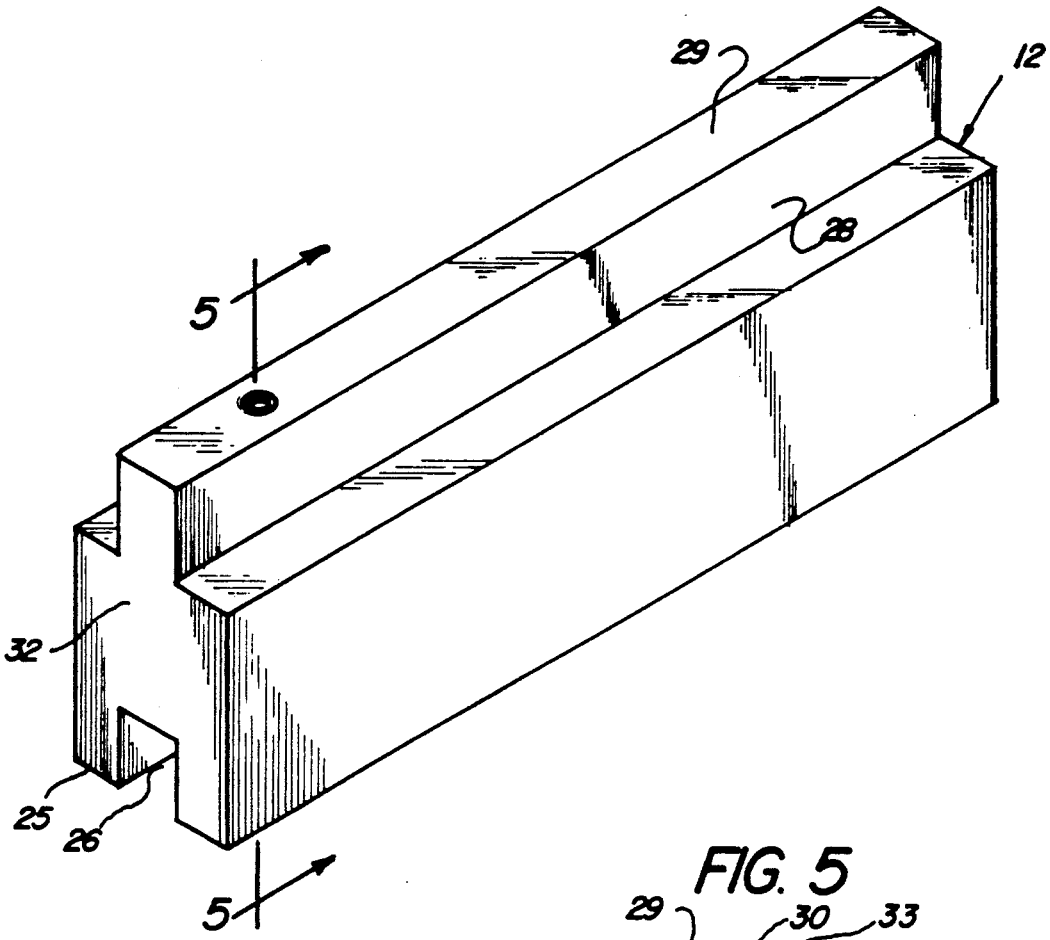
FIG. 4 is an isometric illustration of a second block member utilized by the invention.
Figure 5:
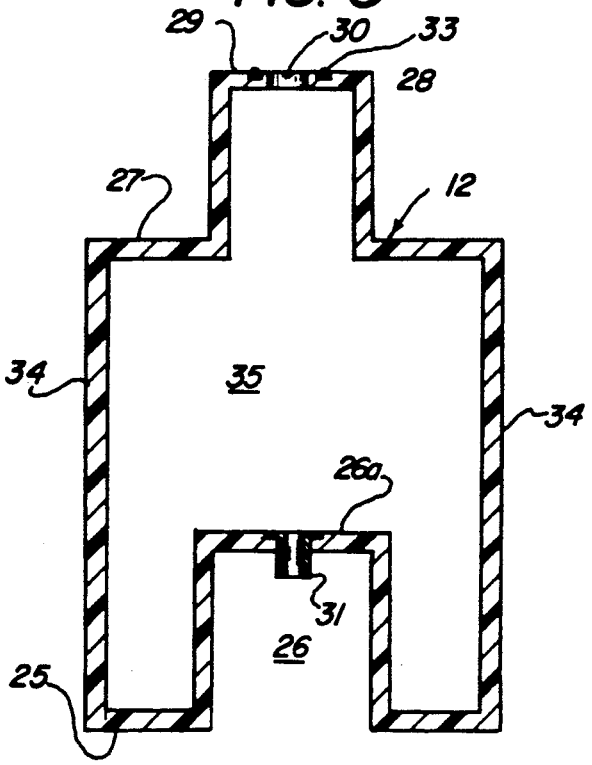
FIG. 5 is an orthographic view, taken along the lines 5—5 of FIG. 4 in the direction indicated by the arrows.
Figure 6:
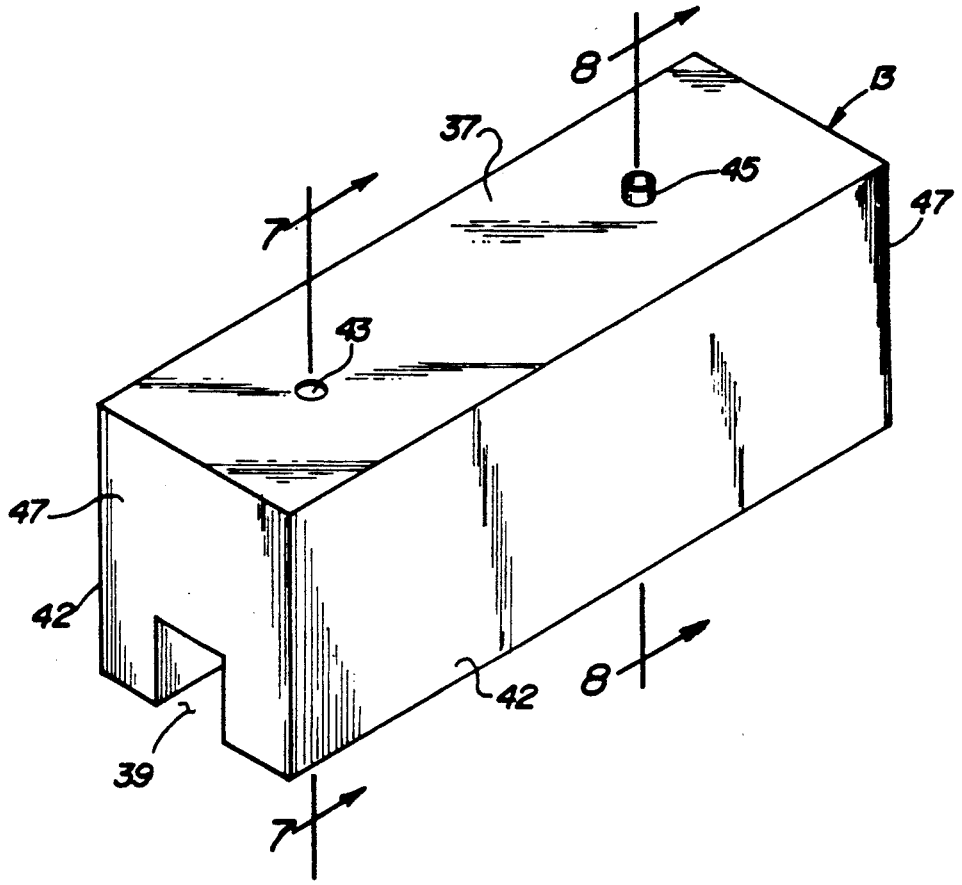
FIG. 6 is an orthographic view of a third category of block utilized by the invention.
Figure 7:
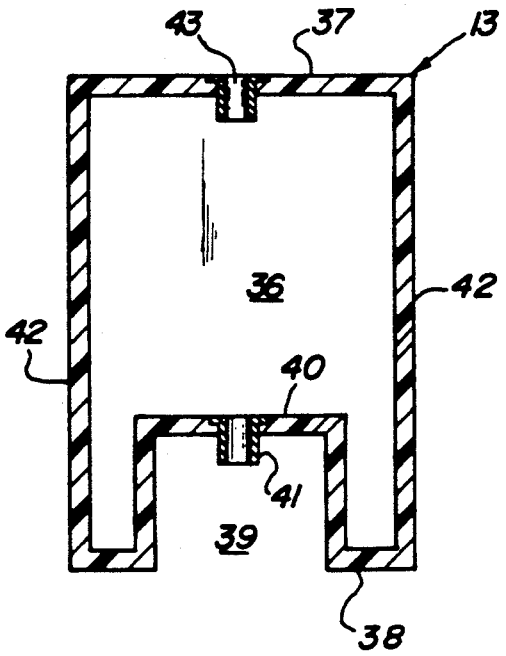
FIG. 7 is an orthographic view, taken along the lines 7—7 of FIG. 6 in the direction indicated by the arrows.
Figure 8:
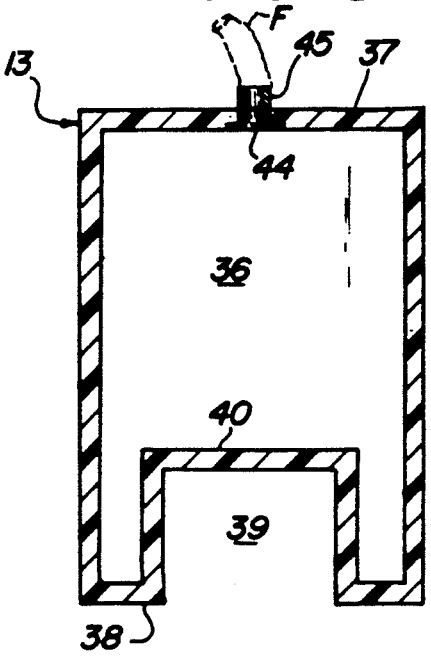
FIG. 8 is an orthographic view, taken along the lines 8—8 of FIG. 6 in the direction indicated by the arrows.

With reference now to the drawings, and in particular to FIGS. 1 to 9 thereof, a new and improved shield apparatus embodying the principles and concepts of the present invention and generally designated by the reference numeral 10 will be described.

Figure 9:
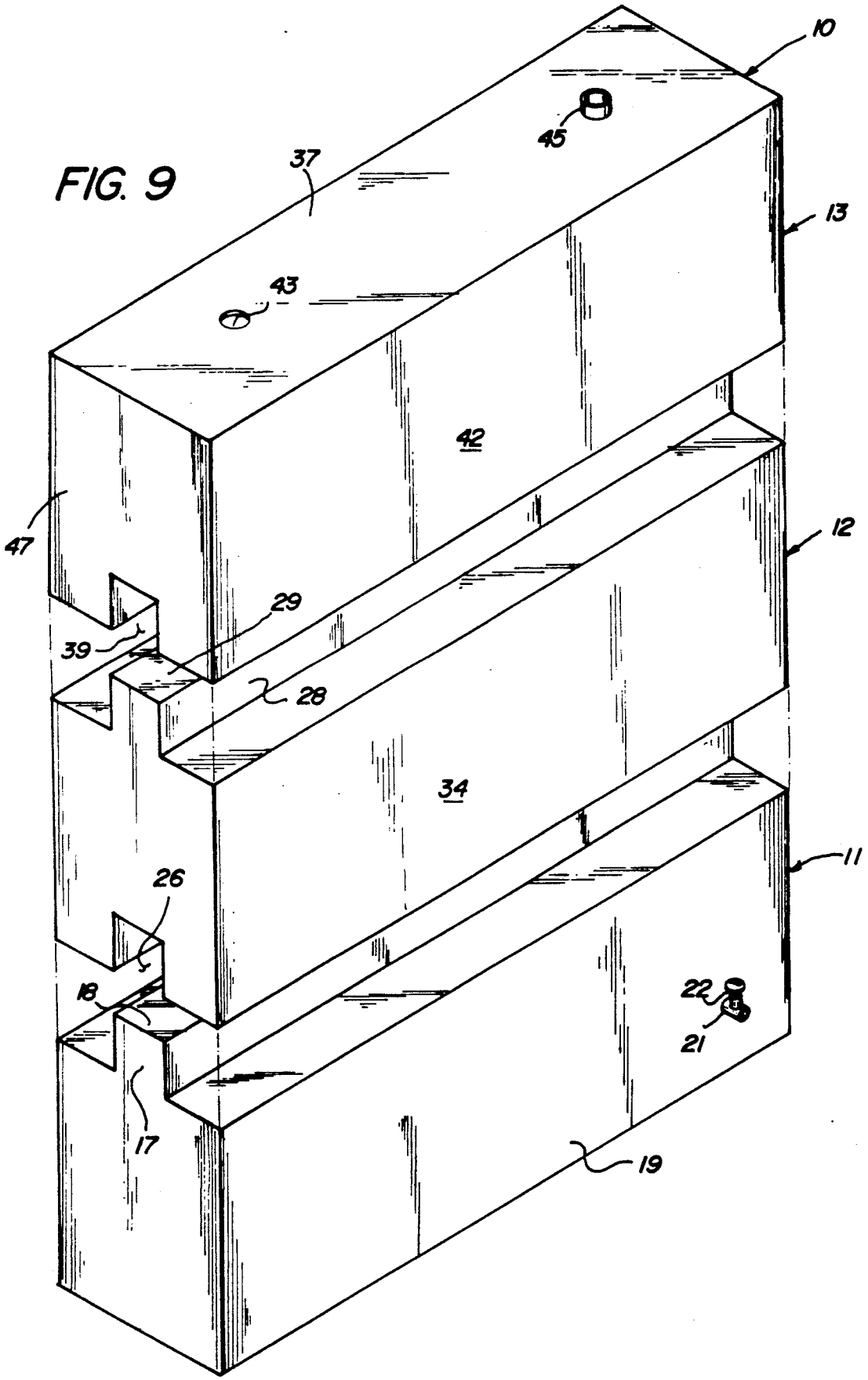
FIG. 9 is an isometric illustration of the invention and its inter-relationship.

More specifically, with reference to FIG. 9, the shield apparatus 10 of the instant invention includes a first block 11 formed as a base block, at least one second block formed as an intermediate block 12, and a third block 13 mounted to an upper surface of the second block 12. It should be noted that a plurality of the intermediate blocks may be utilized, as required, depending on a needed height achieved in the assemblage of the block structure together. The block are each defined by an equal predetermined width and an equal predetermined length to permit the wall portions of the blocks to be formed to a modular construction permitting a plurality of such modular constructions to be assembled together to form a wall of any desired length and height.

The first block 11 includes the first block cavity 14 coextensively directed within the first block. The first block further includes a first floor 15 spaced from and parallel a first top wall 16. A top wall rib 17 projects medially and orthogonally relative to the top wall and is oriented parallel relative to the first side walls 19 and is coextensively directed along the side walls and extends between the first end walls 20 intersecting the end walls in orthogonal relationship. The first top wall rib 17 includes at least a single first bore 23. The first bore 23 is spaced from one of said end walls a predetermined spacing, and includes a continuous torroidal first "O" ring 24 arranged in surrounding relationship relative to the first bore 23 extending above the first rib top wall 18. One of the first side walls 19 includes a drain conduit 21 directed therefrom to permit drainage of fluid from the first block cavity, as well as the second block cavity 35 (see FIG. 5) and the third block cavity 36 (see FIG. 7). The blocks when in an assembled configuration are also filled with water and the blocks each include intercommunicating passages, to be described in more detail below.

The second block 12 includes a second floor 25, with the second floor 25 including a second floor groove 26 extending coextensively between the second end walls 32 and intersecting the second end walls. The groove 26 includes a groove top wall 26*a* that includes a rigid conduit 31 directed through the groove top wall 26*a* and spaced from one of the second end walls 32 said predetermined spacing to interfit and be received within the first bore 23 to effect fluid communication between the second block cavity 35 and the first block cavity 14. A second top wall 27 is spaced from and parallel the second floor 25, as well as the groove top wall 26, with the second top wall 27 including a second top wall rib 28. The second top wall rib 28 includes top wall 29, with a second bore 30 directed therethrough. The second bore 30 is spaced from the second wall the predetermined spacing and is arranged for reception of a rigid conduit 41 defined as the third floor groove top wall rigid conduit 41 that is also spaced from the third end wall 47 of the third block said predetermined spacing to effect fluid communication between the third block cavity and the second block cavity.

A "O" ring 33 is arranged in surrounding relationship relative to the second bore 30 projecting above the second top wall rib top wall 29 to effect a sealing relationship between the rib 28 and the receiving third floor groove 39. The second side walls 34, as noted above, are spaced apart the predetermined width, as are the first side walls 19 and the third side walls 42 of the respective first and third blocks 11 and 13.

The third block 13 is formed with a third top wall 37 spaced from and parallel a third floor 38. The third floor 38 includes the third floor groove 39 directed coextensively between the third block end walls.

The third floor groove top wall rigid conduit 41, as noted above, projects through the third floor groove top wall 40 spaced from one of the end walls the predetermined spacing. A third bore 43 is directed through the third top wall 37 and utilizes a filling bore or alternatively as a venting bore. In this vein, a fourth bore 44 is arranged to be formed with a fourth bore conduit 45 that may be utilized as a vent or alternatively, to receive a fluid-fill conduit "F" secured thereto. In this manner, the ease of filling and venting of the structure once assembled is available. It should be noted that the first, second, and third blocks are each formed of a polymeric material of geometric integrity to define a rigid construction to contain the fluid to be directed therewithin and provide for efficient shielding relative to gamma radiation as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A shield apparatus, comprising, a first block, a second block arranged for mounting to a first top surface of the first block, and a third block arranged for mounting to a second top surface of the second block, and the first block, the second block, and the third block are each of a predetermined length and are each of a predetermined width, and the first block includes a first block cavity, the second block includes a second block cavity, and the third block includes a third block cavity, wherein the first block cavity, the second block cavity, and the third block cavity are each in fluid communication relative to one another when the first block, the second block, and the third block are mounted relative to one another, and the first block includes a first floor and first top wall, with the first top wall spaced from and parallel the first floor, the first top wall includes a first rib coextensively directed along the first top wall and wherein the first block includes parallel first side walls and parallel first end walls, with the first rib extending orthogonally between the first end walls, and one of said first side walls includes a drain conduit directed therethrough in fluid communication with the first cavity, the drain conduit including a valve member arranged for effecting selective fluid flow through the drain conduit, and the first rib including a first rib top wall arranged parallel to and spaced above the first top wall, the first rib top wall including a first bore directed therethrough spaced from one of said first end walls a predetermined spacing, and a continuous torroidal "O" ring mounted in surrounding relationship relative to the first bore and secured to the first rib top wall extending above the first rib top wall.

2. An apparatus as set forth in claim 1 wherein the second block includes a second floor, the second floor including a second floor groove, and the second block further including spaced parallel second end walls and spaced second side walls, with the second floor groove orthogonally directed between the second end walls complementarily receiving the first rib therewithin, the second floor groove including a second floor groove top wall parallel to and spaced above the second floor, with the second floor groove top wall including a rigid conduit directed through the second floor groove top wall, with the rigid conduit extending below the second floor groove top wall and spaced from one of said second end walls for reception within the first bore, and the second block further including a second top wall, the second top wall spaced from and parallel the second floor, and the second top wall including a second rib directed coextensively between the second end walls and orthogonally oriented relative to the second end walls, with the second top wall including a second rib, the second rib including a second rib top wall, the second rib top wall including a second bore, the second bore spaced from one of said second end walls a further predetermined spacing and the second bore including a second "O" ring in surrounding relationship relative to the second bore secured to the second rib top wall and extending above the second rib top wall.

3. An apparatus as set forth in claim 2 wherein the third block includes a third floor and a third top wall spaced from and parallel the third floor, the third floor including a third floor groove, and the third block further including third end walls spaced apart in a parallel relationship, wherein the third groove is orthogonally oriented relative to the third end walls extending through the third end walls, and wherein the third groove includes a third groove top wall, the third groove top wall spaced above and parallel the third floor, the third groove top wall including a rigid conduit spaced from one of said third end walls the further predetermined spacing, wherein the third floor top wall rigid conduit projects below the third floor groove top wall for reception within the second bore, and the third block top wall includes a third bore, and further includes a fourth bore, the fourth bore including a fourth bore conduit projecting above the third top wall for receiving a fluid-filled conduit in securement thereto.

* * * * *